US012383075B2

(12) United States Patent
Pacella et al.

(10) Patent No.: US 12,383,075 B2
(45) Date of Patent: Aug. 12, 2025

(54) ADJUSTABLE CHAIR ASSEMBLY

(71) Applicant: Wonderland Switzerland AG, Steinhausen (CH)

(72) Inventors: Jonathan M. Pacella, Gap, PA (US); Lance J. Clemmer, Mohnton, PA (US); Patrick J. G. Bowers, West Chester, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 68 days.

(21) Appl. No.: 17/894,256

(22) Filed: Aug. 24, 2022

(65) Prior Publication Data

US 2023/0068417 A1 Mar. 2, 2023

Related U.S. Application Data

(60) Provisional application No. 63/237,070, filed on Aug. 25, 2021.

(51) Int. Cl.
*A47D 1/00* (2006.01)

(52) U.S. Cl.
CPC ..... *A47D 1/004* (2013.01); *A47D 1/0085* (2017.05)

(58) Field of Classification Search
CPC ..... A47D 1/0085; A47D 1/004; A47D 1/006
See application file for complete search history.

(56) References Cited

U.S. PATENT DOCUMENTS 3,542,419 A 11/1970 Spinola
5,951,102 A * 9/1999 Poulson ..... A47D 1/023 297/440.16
7,568,758 B2 * 8/2009 Troutman ..... A47D 1/002 297/148
7,673,934 B2 * 3/2010 Bearup ..... A47D 1/004 297/451.3
8,567,867 B2 * 10/2013 Arnold, IV ..... A47D 1/103 297/440.16
9,986,850 B2 * 6/2018 Haut ..... A47D 1/0081
10,588,424 B2 3/2020 Sclare
11,224,298 B2 * 1/2022 Tuckey ..... A47D 1/10
11,564,501 B2 * 1/2023 Dziak ..... A47C 12/02
2011/0074186 A1 3/2011 Zhong
(Continued)

FOREIGN PATENT DOCUMENTS

CN 2927863 Y 8/2007
CN 201150393 Y 11/2008
(Continued)

OTHER PUBLICATIONS

Examination Report issued in corresponding Canadian Application No. 3171375 dated Nov. 1, 2023.

*Primary Examiner* — Philip F Gabler
(74) *Attorney, Agent, or Firm* — Volpe Koenig

(57) ABSTRACT

The present disclosure is directed to an adjustable chair assembly that includes two separate seat assemblies and two separate footrests. The two seat assemblies can be attached to each other in a first state and can be detached from each other in a second state via engagement with an actuator. The adjustable chair assembly can include a plurality of actuator assemblies that can be configured to adjust a recline angle of at least one of the seat assemblies, a height of a frame member, and other aspects of the adjustable chair assembly.

13 Claims, 11 Drawing Sheets

(56) References Cited

U.S. PATENT DOCUMENTS

| | | | | |
|---|---|---|---|---|
| 2016/0007766 | A1* | 1/2016 | Sack | A47D 1/023<br>297/16.1 |
| 2017/0251826 | A1* | 9/2017 | Sclare | A47D 1/008 |
| 2018/0279801 | A1* | 10/2018 | Ingraham | A47D 1/0083 |
| 2019/0231087 | A1 | 8/2019 | Dziak | |

FOREIGN PATENT DOCUMENTS

| | | | |
|---|---|---|---|
| CN | 202060384 | U | 12/2011 |
| CN | 207285732 | U | 5/2018 |

* cited by examiner

ADJUSTABLE CHAIR ASSEMBLY

CROSS-REFERENCE TO RELATED APPLICATION

This application claims priority to U.S. Provisional Patent Application No. 63/237,070, filed on Aug. 25, 2021, the disclosure of which is hereby incorporated by reference as if set forth in its entirety herein.

TECHNICAL FIELD

The present disclosure generally relates to an adjustable chair assembly, and is specifically directed to an adjustable chair assembly with two separate chair assemblies or modes.

BACKGROUND

Chair assemblies for infants, toddlers, and juveniles are well known. One such chair assembly is a highchair, which is generally configured to be used in a dining area. It is desirable to provide chair assemblies that can be used with standard height kitchen or dining tables, as well as chair assemblies that can be used with taller dining surfaces, such as kitchen islands or counters.

Some known highchairs provide the ability to support children of varying sizes, such as infants, toddlers, and juveniles or youths. These known highchairs typically include a single footrest for the various modes of use for children of varying sizes. This can be undesirable due to the single footrest being more suitable for one mode over the other.

Other known highchairs provide the ability to remove one seat assembly from another seat assembly. These types of highchairs require users to engage a pair of actuators (i.e. using two hands) in order to remove one seat assembly from another seat assembly. This is also undesirable because users may be holding other items while trying to engage with the highchair.

Accordingly, it would be desirable to provide an improved chair assembly that is easily actuated to convert between various modes or states, and also provides more adjustment or flexibility aspects.

SUMMARY

The present disclosure is directed to an adjustable chair assembly. In one aspect, the adjustable chair assembly includes a first seat assembly, a first footrest, a second seat assembly, and a second footrest that is different than the first footrest. The first and second seat assemblies are configured to be transitioned between a first state in which the first and second seat assemblies are attached to each other, and a second state in which the first and second seat assemblies are detached from each other. A seat release actuator is configured to detach the first and second seat assemblies from each other to transition from the first state to the second state. In one aspect, the seat release actuator comprises a single handle.

Additional embodiments are described below and in the claims.

BRIEF DESCRIPTION OF THE DRAWINGS

The foregoing Summary and the following Detailed Description will be better understood when read in conjunction with the appended drawings, which illustrate a preferred embodiment of the disclosure. In the drawings.

DETAILED DESCRIPTION

Figure 1A:
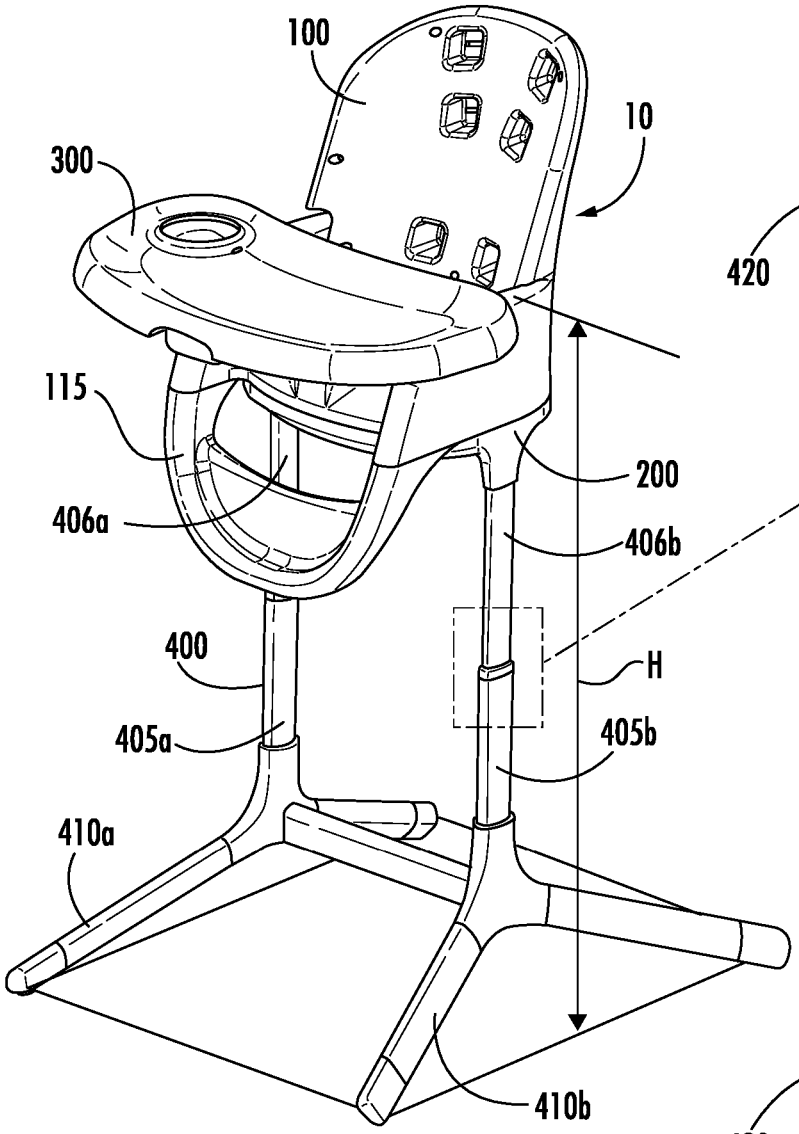
FIG. 1A is a perspective view of an adjustable chair assembly according to one aspect.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. This terminology includes the words specifically noted above, derivatives thereof and words of similar import.

As shown in FIG. 1A, an adjustable chair assembly 10 is disclosed herein that generally includes a first seat assembly 100, a second seat assembly 200, a tray assembly 300, and a frame assembly 400.

In one aspect, the first seat assembly 100 is configured to support a child of a first size or first age, and the second seat assembly 200 is configured to support a child of a second size or second age. For example, the first seat assembly 100 can be a booster seat that is generally dimensioned or adapted to support a toddler. The second seat assembly 200 can dimensioned or adapted to support an older or larger child. In this aspect, the second seat assembly 200 can be configured as a youth seat, and may be a stool. One of ordinary skill in the art would understand that either of the first or second seat assemblies 100, 200 could be dimensioned or sized to support children of varying ages, sizes, heights, etc. Although not specifically shown, restraints can be included for either one of the first or second seat assemblies 100, 200.

The adjustable chair assembly 10 generally provides varying levels of adjustability and adaptability. For example, the first and second seat assemblies 100, 200 can each be configured to be selectively detached from a remainder of the adjustable chair assembly 10. Additionally, the adjustable chair assembly 10 can generally have a height adjustment feature such that the adjustable chair assembly 10 is configured to be used at a plurality of heights. For example, the adjustable chair assembly 10 can be configured to be used with tables of standard height (i.e. preferably 26-30 inches, more preferably 28-30 inches, and most preferably about 28.5 inches) in a lower height adjustment setting, or to be used with taller tables, such as kitchen islands (i.e. preferably 34-38 inches, more preferably 35-37 inches, and most preferably about 36.5 inches) in an upper height adjustment setting. The heights disclosed herein are measured from a floor or ground surface to a top of an armrest defined by the first seat assembly 100. One of ordinary skill in the art would understand that the height adjustment feature could be configured to adjust to any height.

As disclosed in more detail herein, a plurality of actuators are provided with the adjustable chair assembly 10 for adjusting a variety of aspects of the adjustable chair assembly 10 and/or for detaching one component from another of the adjustable chair assembly 10. Each of the actuators disclosed herein are configured to be engaged with a single hand of a user. This configuration generally makes it easier and simpler for a user to adjust or modify aspects of the adjustable chair assembly 10.

As shown in FIG. 1A, the frame assembly 400 is generally configured to provide a ground support for the first and second seat assemblies 100, 200. The frame assembly 400 includes at least one leg or support. In one aspect, the frame assembly 400 includes a pair of legs. In another arrangement, the frame assembly 400 can include a single leg, or more than two legs.

A first leg of the pair of legs can be comprised of two sections 405*a*, 406*a* that are configured to be adjustable relative to each other, such as via a telescoping arrangement. A second leg of the pair of legs can be comprised of two sections 405*b*, 406*b* that are configured to be adjustable relative to each other, such as via a telescoping arrangement. Based on this arrangement, a height (H) of the frame assembly 400 can be adjusted. The frame assembly 400 can include a ground support element, i.e. feet for the legs. In one aspect, the ground support element comprises two ground supports 410*a*, 410*b*. The ground supports 410*a*, 410*b* can each include a fork-like shape including a pair of supports, in one aspect. One of ordinary skill in the art would understand that the configuration of the ground supports 410*a*, 410*b* can vary.

Figure 1B:
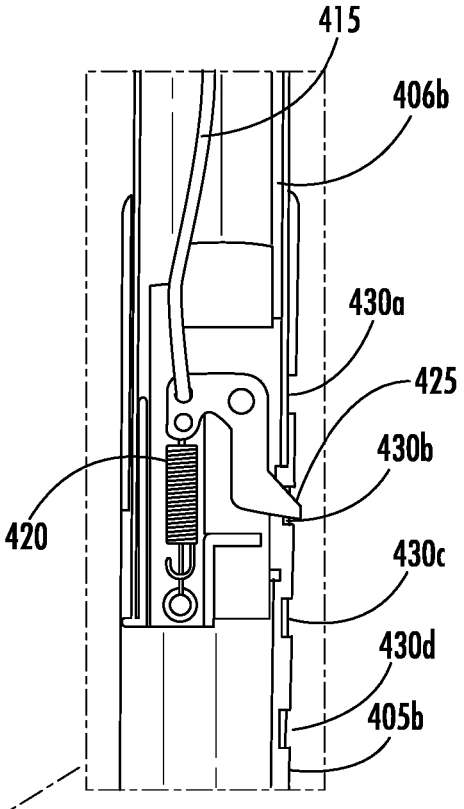
FIG. 1B is a magnified view of a height adjustment feature of the adjustable chair assembly of FIG. 1A in a first state.
Figure 1C:
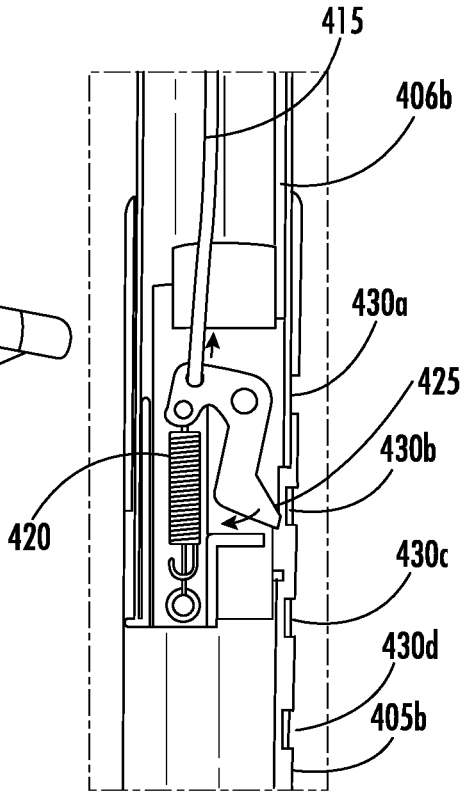
FIG. 1C is a magnified view of a height adjustment feature of the adjustable chair assembly of FIG. 1A in a second state.
Figure 2:
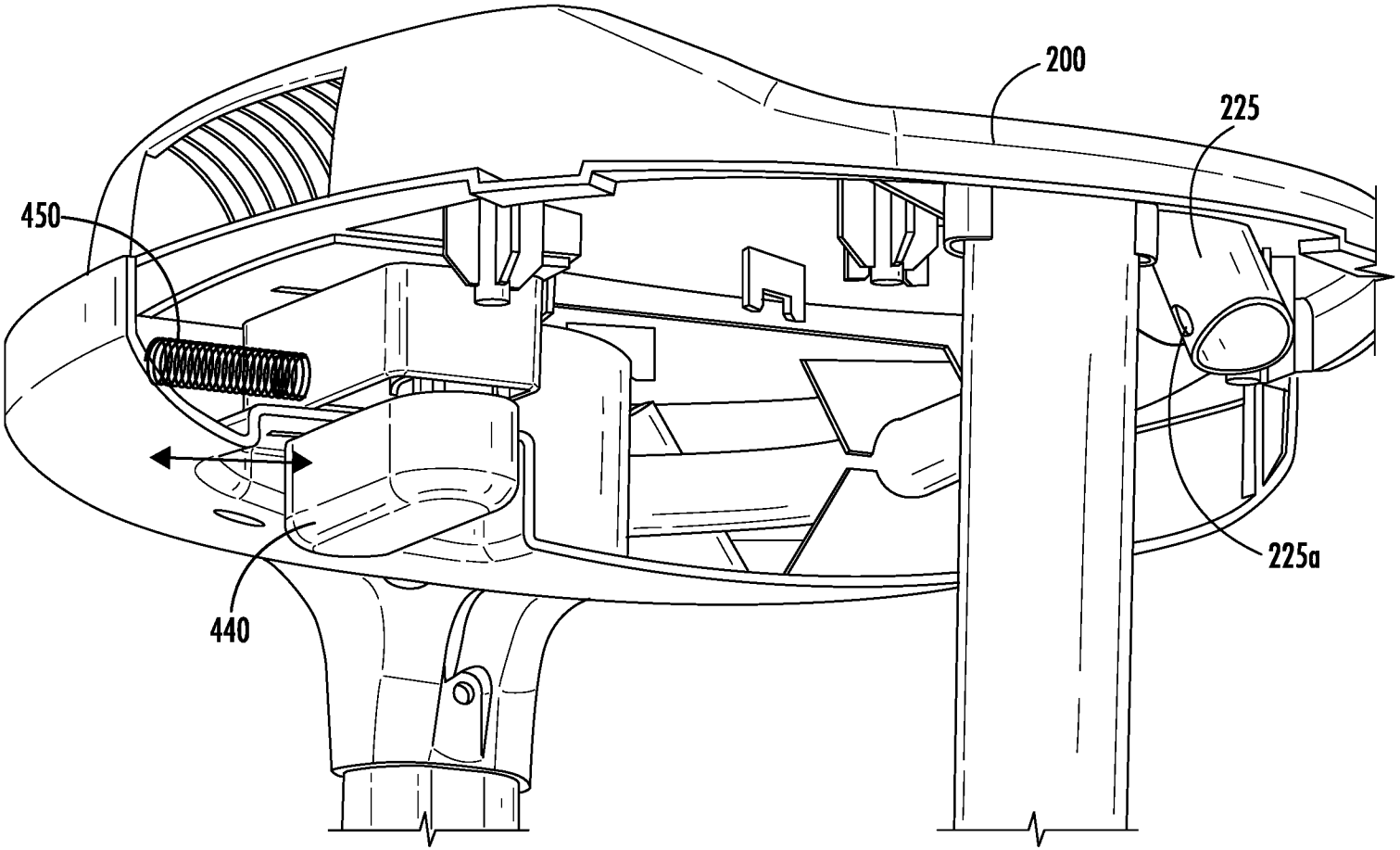
FIG. 2 is a cutaway perspective view of a portion of the height adjustment feature of the adjustable chair assembly.
Figure 3B:
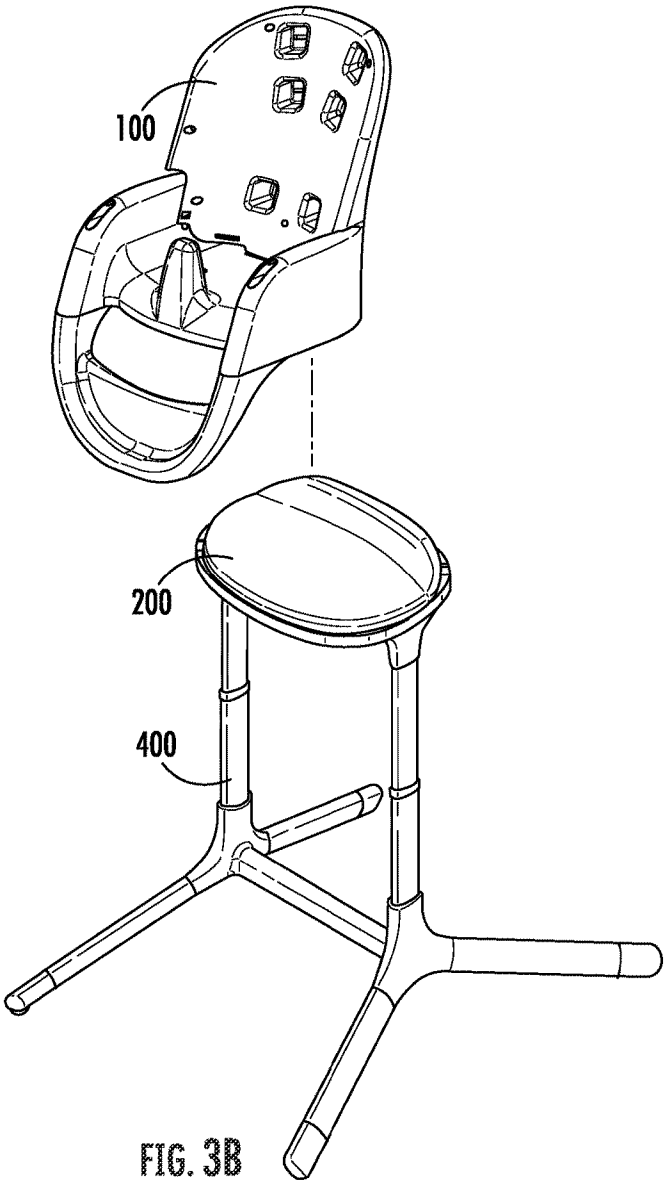
FIG. 3B is a perspective view of the adjustable chair assembly of FIG. 3A with the first seat assembly detached from the second seat assembly.
Figure 3A:
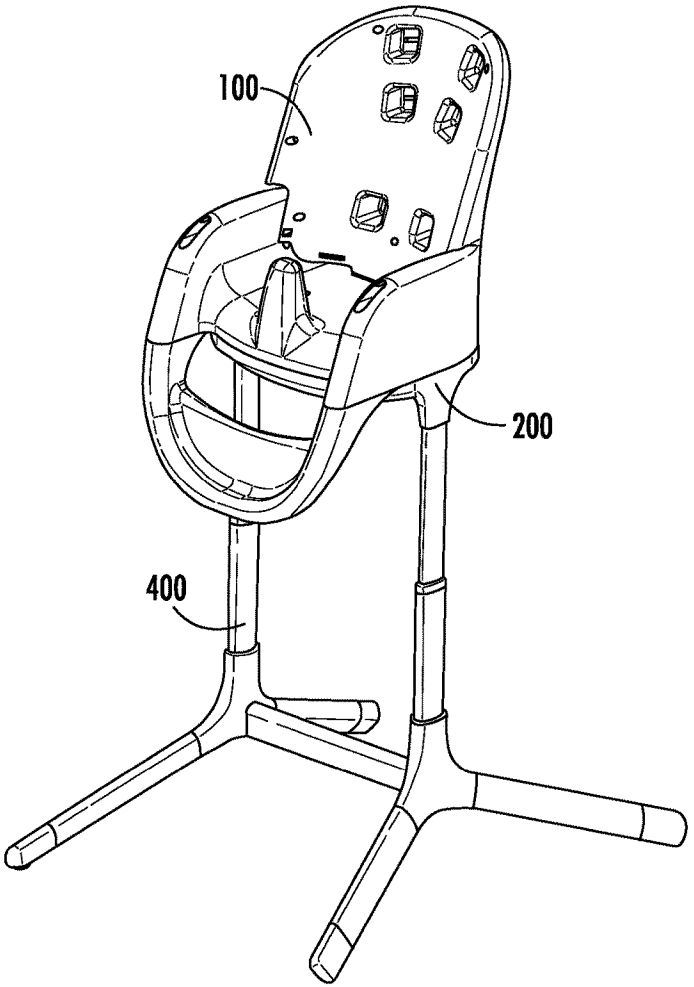
FIG. 3A is a perspective view of the adjustable chair assembly with the first and second seat assemblies attached to each other.

As shown in more detail in FIGS. 1B and 1C, the frame assembly 400 includes a height adjustment feature that is configured to adjust a height of the frame assembly 400. The height adjustment feature can have a variety of configurations. In one aspect, the height adjustment feature includes a control element 415 (i.e. cable, lever, rod, linkage, etc.) that is configured to be engaged by an actuator 440 (i.e. a handle, lever, etc.), as shown in FIG. 2. Pulling the actuator 440, as shown in FIG. 2, causes the control element 415 to be pulled upward, in one aspect, as is shown in FIG. 1C. The control element 415 is configured to selectively move or displace a locking element, such as a latch or pawl 425. One end or portion of the latch 425 is dimensioned to be received within a selective one of a plurality of height adjustment openings 430*a*, 430*b*, 430*c*, and 430*d*. The latch 425 is shown within height adjustment opening 430*b* in FIG. 1B, and is shown pivoted out of contact with the height adjustment openings in FIG. 1C in order to adjust the height. In one aspect, the height adjustment openings 430*a*, 430*b*, 430*c*, and 430*d* are formed in a bottom portion, i.e. elements 405*a* or 405*b*, of the frame support. In another aspect, the height adjustment openings 430*a*, 430*b*, 430*c*, 430*d* are formed in an upper portion, i.e. elements 406*a* or 406*b*, of the frame support. The bottom portion 405*a*, 405*b* of the frame and the upper portion 406*a*, 406*b* of the frame can be configured to be slidable relative to each other. The latch 425 is configured to selectively lock the bottom portion 405*a*, 405*b* of the frame with the upper portion 406*a*, 406*b* of the frame to fix the height of the frame assembly 400. In one aspect, a biasing element 420 is provided to bias the latch 425 into a locked position and within a selective one of the height adjustment openings 430*a*, 430*b*, 430*c*, 430*d*. Although a telescoping arrangement is shown in FIGS. 1A-1C, one of ordinary skill in the art would understand that various types of height adjustment mechanisms and configurations could be used.

As shown in FIG. 2, the actuator 440 can be provided on an underside of the second seat assembly 200. One of ordinary skill in the art would understand that the actuator 440 for height adjustment of the frame assembly 400 can be located in any location of the adjustable chair assembly 10. A biasing element 450 can be provided that generally forces the actuator 440 to a non-engaged or non-actuated position, i.e. a position in which the control element 415 is not pulled or tensioned. In one aspect, the biasing element 450 can be a spring, such as a coil spring or a flat spring, a resilient material, or any other component that is configured to generally urge the actuator 440 to an initial or non-actuated position. In one aspect, the actuator 440 is arranged on a rear or back side of the second seat assembly 200. As shown in FIG. 2, a single actuator 440 is provided. The single actuator 440 is configured to tension or pull control elements 415 arranged in the supports of the frame assembly 400, such that a user only has to use one hand to adjust a height of the frame assembly 400. In another configuration, the height adjustment feature can include an actuator formed on a lower region of the frame assembly 400, such that a user can selective engage the actuator with their foot. The height adjustment actuator could alternatively be provided on one of the legs of the frame assembly 400.

Figure 4B:
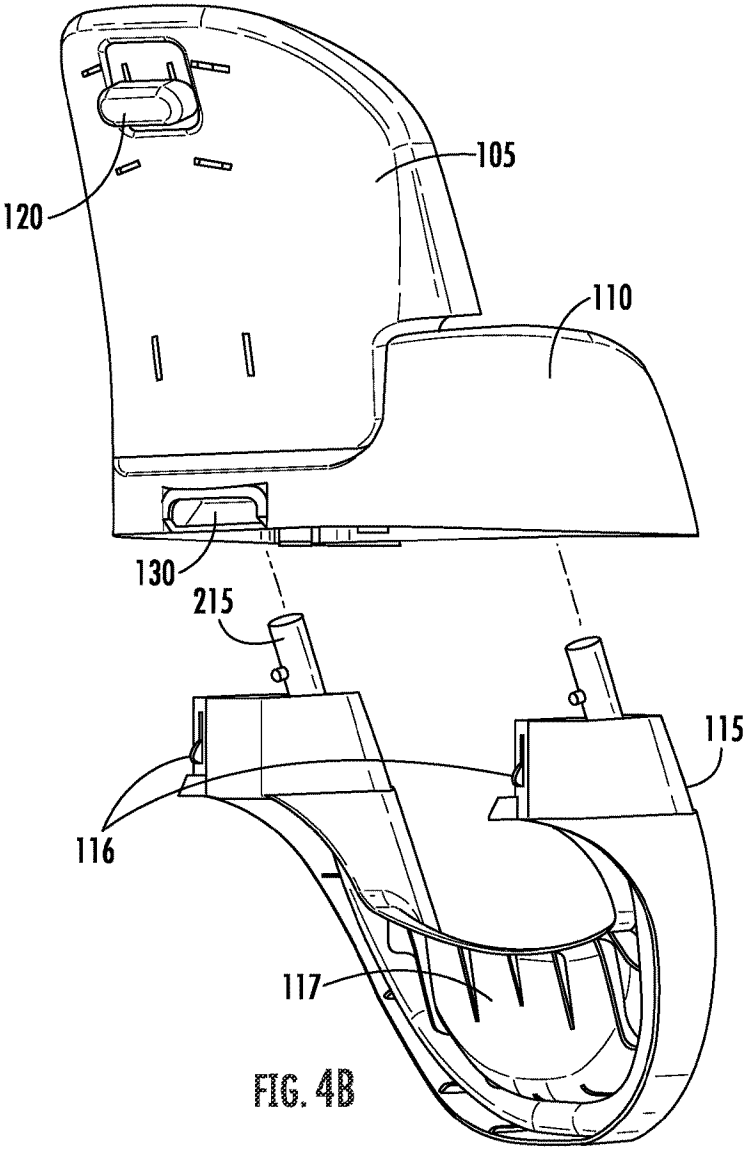
FIG. 4B is another perspective view of the first seat assembly of FIG. 4A.
Figure 4A:
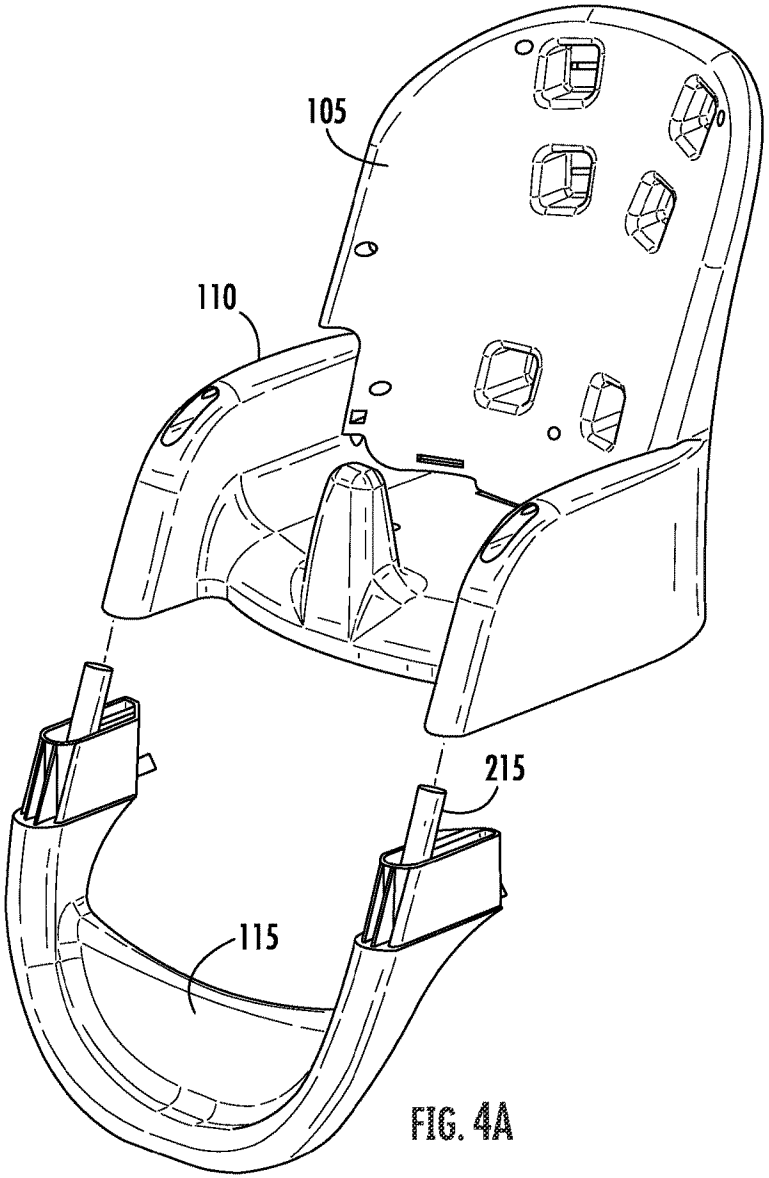
FIG. 4A is a perspective view of the first seat assembly in a partially disassembled state.

As shown in FIGS. 4A and 4B, the first seat assembly 100 can include multiple components or sections that are configured to be separated from each other. In one aspect, the first seat assembly 100 can include a first portion or seat back portion 105, a second portion or seat portion 110, and a third portion or footrest 115. One of ordinary skill in the art would understand that the first seat assembly 100 can be formed as a single unitary component, or could be formed from fewer or more components than illustrated.

In one aspect, the footrest 115 is a first footrest 115 and the second seat assembly 200 includes a second footrest 215.

As shown in FIGS. 4A, and 4B, the second footrest 215 is configured to at least be partially received within the first footrest 115. In one aspect, the first footrest 115 is formed as a plastic shell, and the second footrest 215 is formed as a bar or rod support and is formed from metal. One of ordinary skill in the art would understand that the materials forming the footrests 115, 215 can vary.

As shown in FIG. 4B, the second footrest 215 can be stowed inside of a receptacle defined by the first footrest 115 such that the second footrest 215 is hidden when stowed. Based on this arrangement, removal of the first footrest 115 also causes removal of the second footrest 215 from a remainder of the assembly 10. The second footrest 215 can then be removably coupled to the second seat assembly 200 when it is separated from the first footrest 115. The first footrest 115 can define a cavity 117 on a rearward face of the first footrest 115. The first footrest 115 can include at least one retention element, such as a clip or fingers, configured to selectively receive and retain the second footrest 215. Removal of the second footrest 215 from the first footrest 115 can require slight pressure or pulling by a user. In another aspect, a locking element can be configured to secure the first footrest 115 to the second footrest 215. Other configurations for storing or stowing the second footrest 215 can be used.

In one aspect, a connection arrangement can be provided between a portion of the first footrest 115 and the seat portion 110. For example, fasteners 116, such as latches, tabs, protrusions or other types of fasteners or securing elements, can be provided on a first one of the first footrest 115 or the seat portion 110 that are configured to be received within a corresponding pocket, opening, or other type of receptacle on a second one of the first footrest 115 or the seat portion 110. Connections between the first footrest 115 and the seat portion 110 can vary, as one of ordinary skill in the art would understand based on this disclosure. Alternatively, the first footrest 115 can be connected to the seat back 105. In order to access the second footrest 215, the first footrest 115 can be removed such that a user can freely access and pull the second footrest 215 out of the first footrest 115.

As shown in FIGS. 4A and 4B, with the footrest 115 removed, the first seat assembly 100 can function or operate as a standalone booster seat that only includes the seat portion 110 and the seat back 105. Optionally, the seat back 105 could be removed from the seat portion 110 such that the seat portion 110 is a standalone seat device. One of ordinary skill in the art would understand that either of these configurations can sit on a floor surface, chair surface, or any other type of surface. Restraints can be provided to secure the first seat assembly 100 to a support structure, such as a chair.

As shown in FIG. 4B, the first seat assembly 100 can include at least two actuators 120, 130. In one aspect, a first actuator 120 of the first seat assembly 100 is configured to adjust an angle or position of the first portion 105 (i.e. seat back) relative to the second portion 110 (i.e. seat portion). In one aspect, a second actuator 130 of the first seat assembly 100 is configured to selectively release the first seat assembly 100 relative to the second seat assembly 200. In one aspect, the first actuator 120 of the first seat assembly 100 is provided in an upper region of the first seat assembly 100, and the second actuator 130 is provided in a lower region of the first seat assembly 100. One of ordinary skill in the art would understand that the exact position of the first and second actuators 120, 130 can vary. In one aspect, the first actuator 120 is a seat back recline actuator, and the second actuator 130 is a removal latch or actuator.

Figure 5:
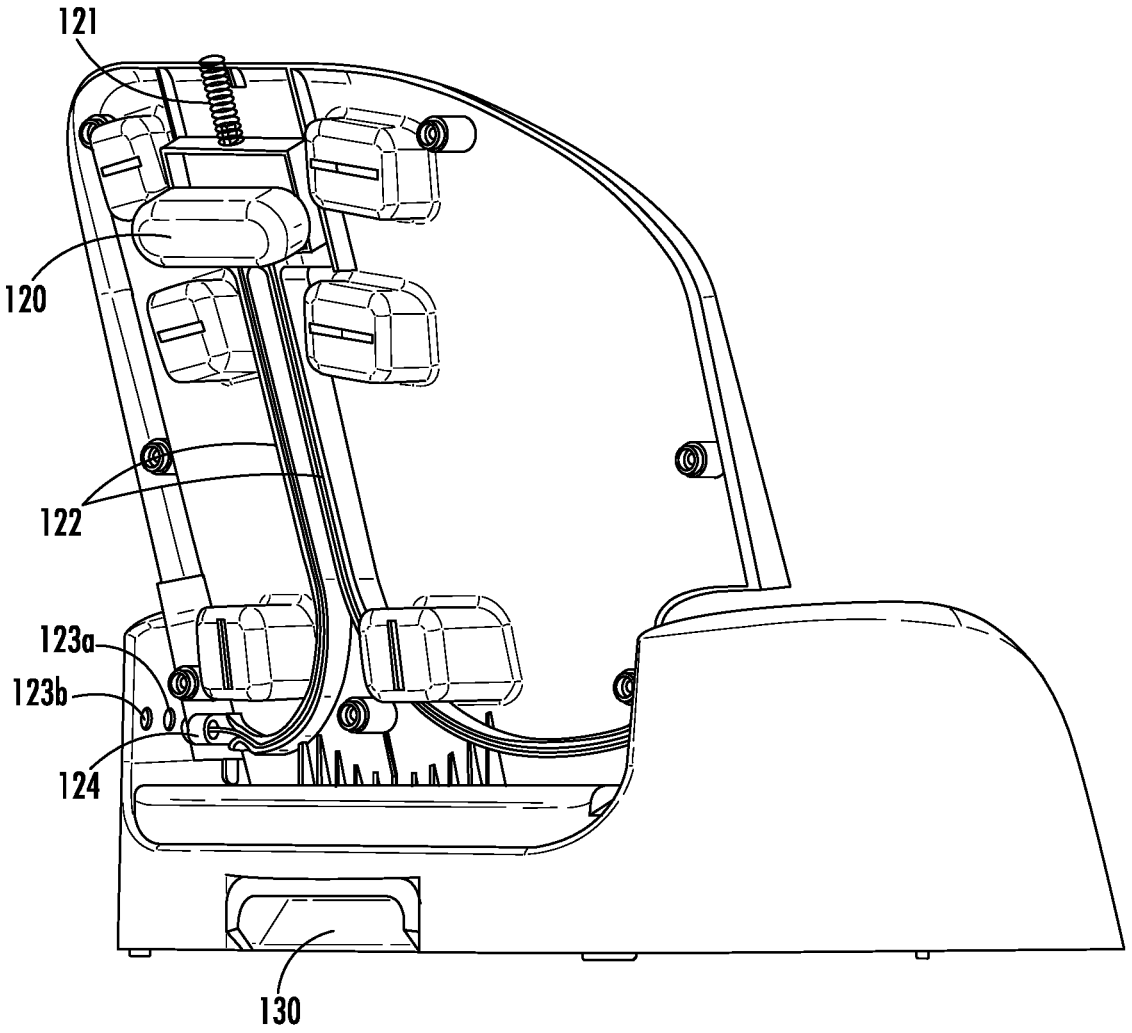
FIG. 5 is a rear perspective view of an actuator assembly for the first seat assembly.

As shown in more detail in FIG. 5, the first actuator 120 can be configured to tension or pull control elements 122, such as cables. One of ordinary skill in the art would understand that other types of control elements, such as linkages, rods, bars, etc., can be used. The control elements 122 can be attached at terminal ends to locking elements 124, such as plungers or latch pins. The locking elements 124 can be configured to be selectively engaged within a respective opening 123*a*, 123*b*. In one aspect, the openings 123*a*, 123*b* are angular reclining openings. A user can pull the first actuator 120 and then manually adjust an incline angle of the first portion 105 relative to the second portion 110 based on the locking elements 124 engaging with a selected one of the openings 123*a*, 123*b*.

A biasing element 121 can be provided that is configured to force the first actuator 120 into a non-engaged or non-actuated position. Each of these components associated with the first actuator 120 can be housed within a cavity defined by a shell of the first seat assembly 100. One of ordinary skill in the art would understand that various configurations could be used to provide the ability to adjust one portion of the first seat assembly 100 relative to another.

Figure 6:
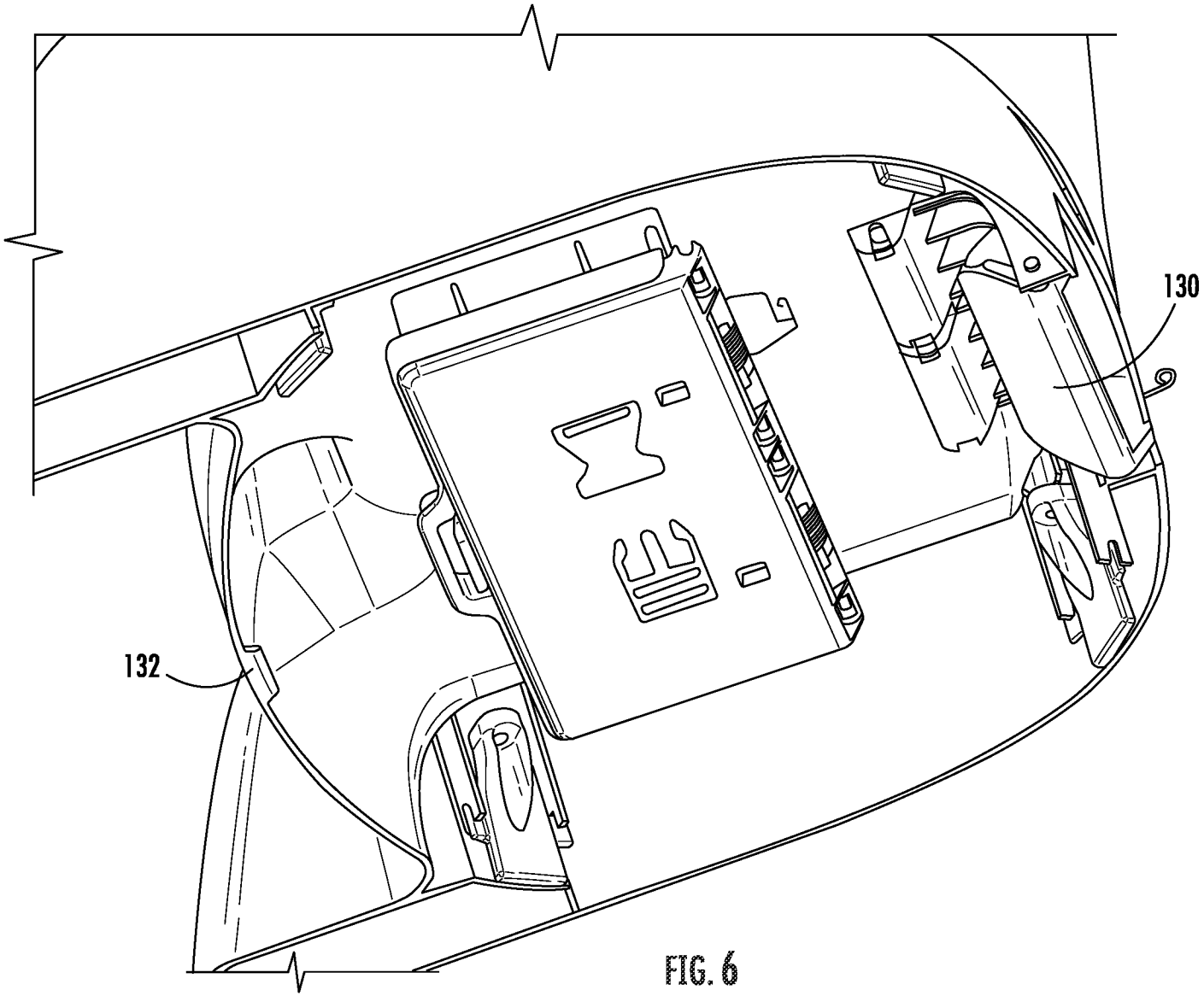
FIG. 6 is a perspective view of an underside of the first seat assembly illustrating another actuator assembly.

As shown in FIG. 6, a retention feature is provided that is generally configured to secure the first and second seat assemblies 100, 200. As shown in FIG. 6, the second actuator 130 can be configured to cooperate with a retention element 132 (i.e. a retainer, pocket, clip, protrusion, projection, etc.) such that the first and second seat assemblies 100, 200 are selectively secured or attached to one another. A user can engage, i.e. pull or displace, the second actuator 130 such that the first seat assembly 100 can be removed or detached from the second seat assembly 200. Engaging the second actuator 130 can cause either the first or second seat assemblies 100, 200 to move relative to each other and disengage the first or second seat assemblies 100, 200 relative to the retention element 132. In one aspect, the retention element 132 is a protrusion for a toe-in attachment arrangement between the first and second seat assemblies 100, 200. Based on this configuration, the second actuator 130 provides an arrangement in which a user can use a single hand to detach the first seat assembly 100 from the second seat assembly 200. In one aspect, a first state corresponds to a condition in which the first and second seat assemblies 100, 200 are secured with each other, and a second state corresponds to a condition in which the first and second seat assemblies 100, 200 are detached from each other. One of ordinary skill in the art would understand that other types of interfaces and structures can be used to provide the ability to connect the first and second seat assemblies 100, 200. In one aspect, latches can be provided that selectively retract or extend based on engagement with the actuator 130. In another aspect, a slot or groove can be provided in one of the first or second seat assemblies 100, 200 and the other one of the first or second seat assemblies 100, 200 can be dimensioned to slide therein. In one aspect, the actuator 130 can be omitted and detachment between the first and second seat assemblies 100, 200 can require a user pulling one of the first or second seat assemblies 100, 200 relative to each other, preferably at a predetermined angle. In this configuration, relatively simple retention features, such as flexible fingers or snap-fit elements, may be provided on one of the first or second seat assemblies 100, 200.

Figure 7A:
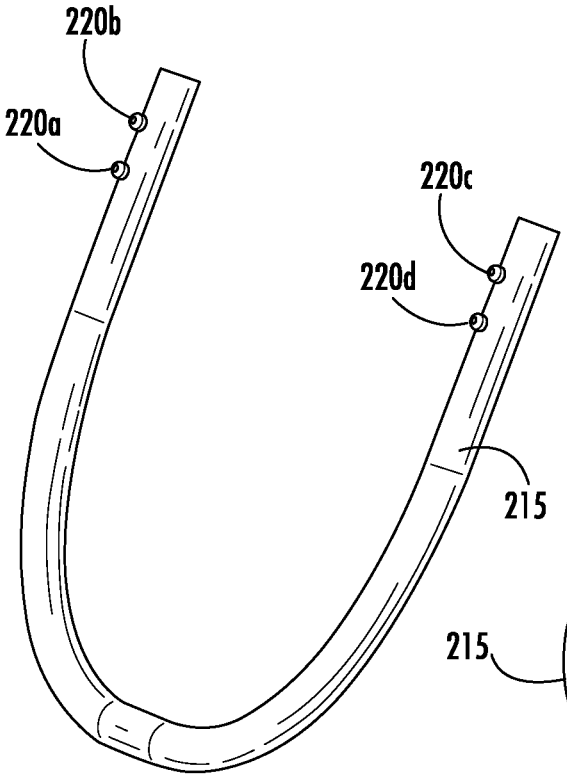
FIG. 7A is a perspective view of a footrest for the second seat assembly in a detached state.
Figure 7B:
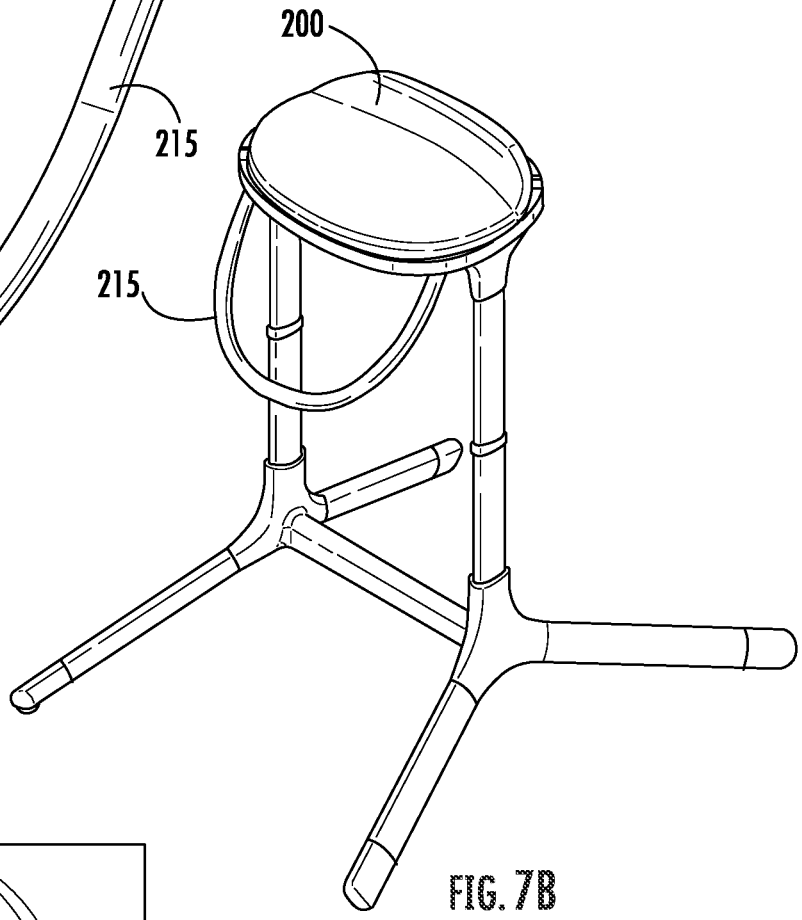
FIG. 7B is a perspective view of the footrest attached to the second seat assembly.
Figure 7C:
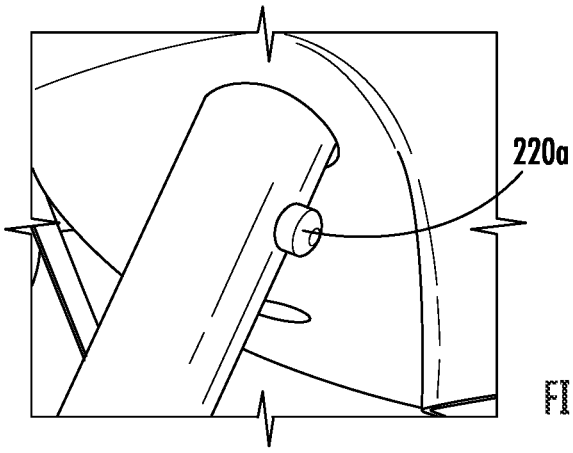
FIG. 7C is a magnified view of a portion of the second footrest of FIGS. 7A and 7B.

FIGS. 7A-7C illustrate additional details of the second footrest 215 and the second seat assembly 200. The second footrest 215 can be formed as a generally U-shaped bar, rod, or pipe, in one aspect. One of ordinary skill in the art would understand that the second footrest 215 can be formed according to a variety of different shapes, profiles, or configurations. As shown in FIG. 7A, the second footrest 215 includes two pairs of couplers 220*a*, 220*b* and 220*c*, 220*d*. In one aspect, an upper one of the couplers 220*b*, 220*c* are configured to be selectively secured within a corresponding receptacle defined on an underside of the second seat assembly 200 or any other portion of the assembly 10. FIG. 2 illustrates at least one post 225 defined by the second seat assembly 200 that defines a receptacle 225*a* configured to receive at least one of the couplers 220*a*-220*d*. The receptacles for the couplers 220*a*, 220*b*, 220*c*, 220*d* can alternatively be defined on the frame assembly 400. In one aspect, the couplers 220*a*, 220*b*, 220*c*, 220*d* are snap buttons that are outwardly biased. A user can manually depress the snap buttons to be retracted inside of the frame of the second footrest 215.

In one aspect, a lower one of the couplers 220*a*, 220*d* can remain exposed (i.e. visible to a user) on the underside of the second seat assembly 200. In one aspect, the first pair of couplers 220*a*, 220*b* are linked with each other, and the second pair of couplers 220*c*, 220*d* are linked with each other. A user can slide the terminal or free ends of the second footrest 215 into receptacles on the underside of the second seat assembly 200 such that the upper one of the couplers 220*b*, 220*c* lock into place. To remove the second footrest 215, a user can depress the lower one of the couplers 220*a*, 220*d* such that the upper one of the couplers 220*b*, 220*c* retract and the second footrest 215 can be pulled downward and away from the second seat assembly 200. One of ordinary skill in the art would understand that this configuration could be reversed such that the second footrest 215 defines receptacles and the underside of the second seat assembly 200 defines retractable couplers. FIG. 7C illustrates the second footrest 215 engaged with the second seat assembly 200, wherein the coupler 220*b* is inside of the second seat assembly 200 to retain the second footrest 215, and the coupler 220*a* remains exposed and accessible to a user to remove the second footrest 215 from the second seat assembly 200. In one aspect, the second footrest 215 can have a single connection point with the rest of the assembly 10 instead of having two free ends. Various configurations for attaching the second footrest 215 to the assembly 10 can be used.

Figure 8A:
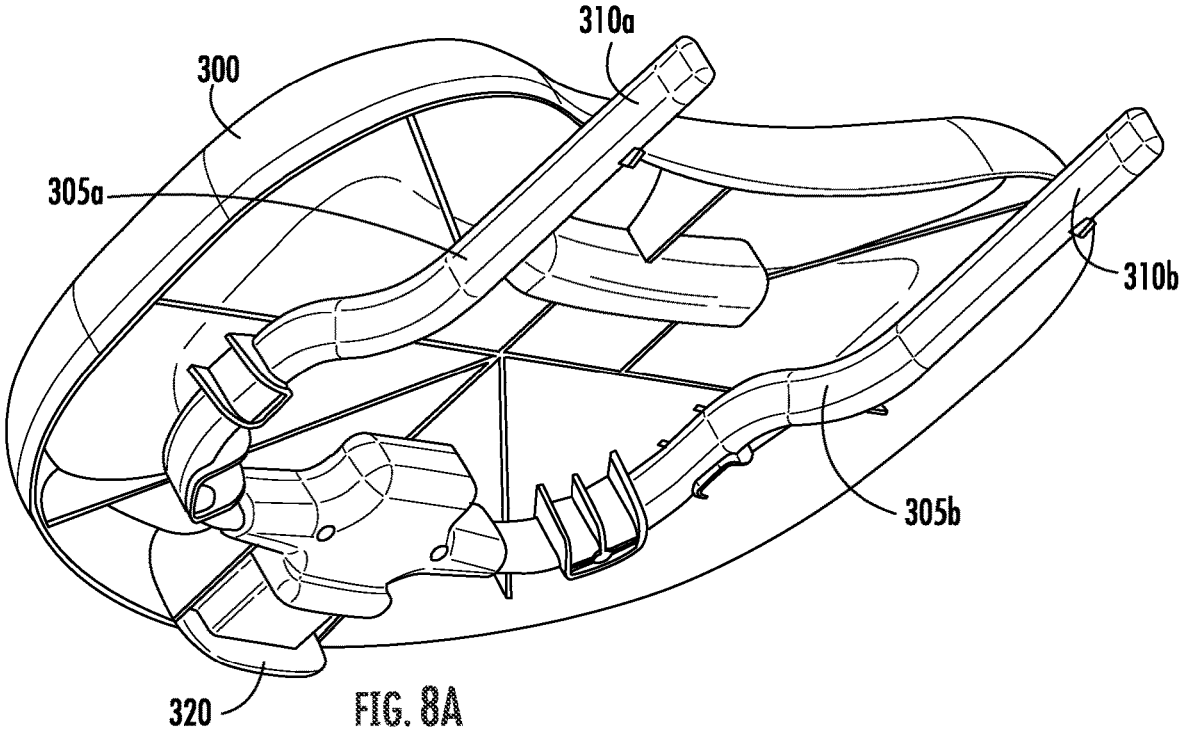
FIG. 8A is a perspective view of an underside of a tray assembly.
Figure 8B:
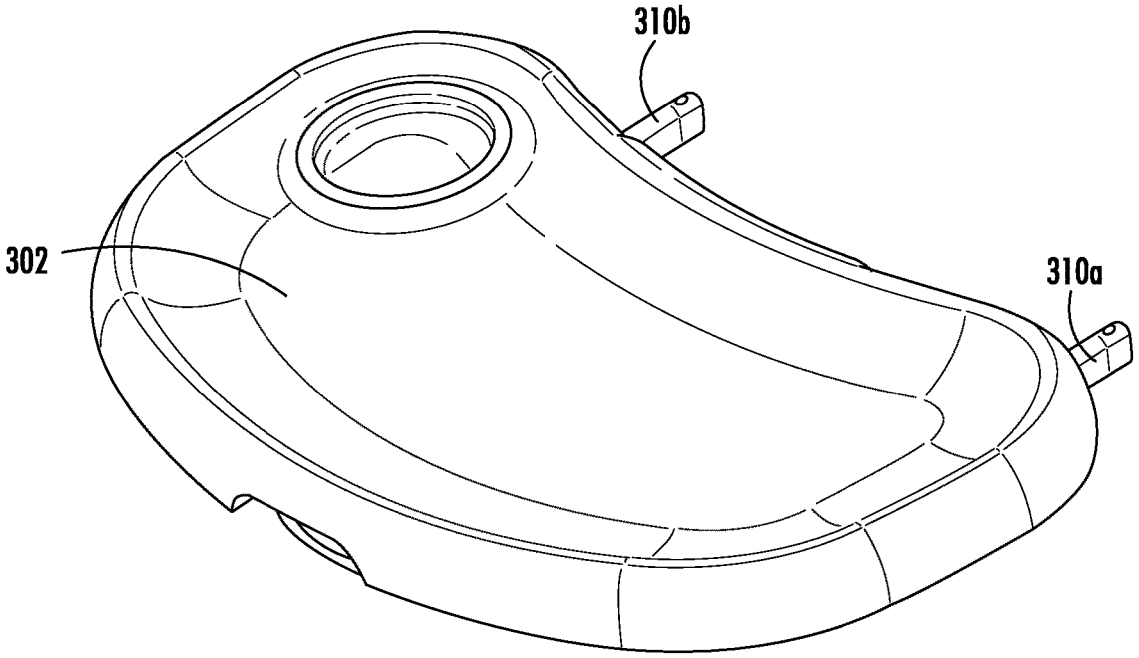
FIG. 8B is a perspective view of a top surface of the tray assembly.
Figure 8C:
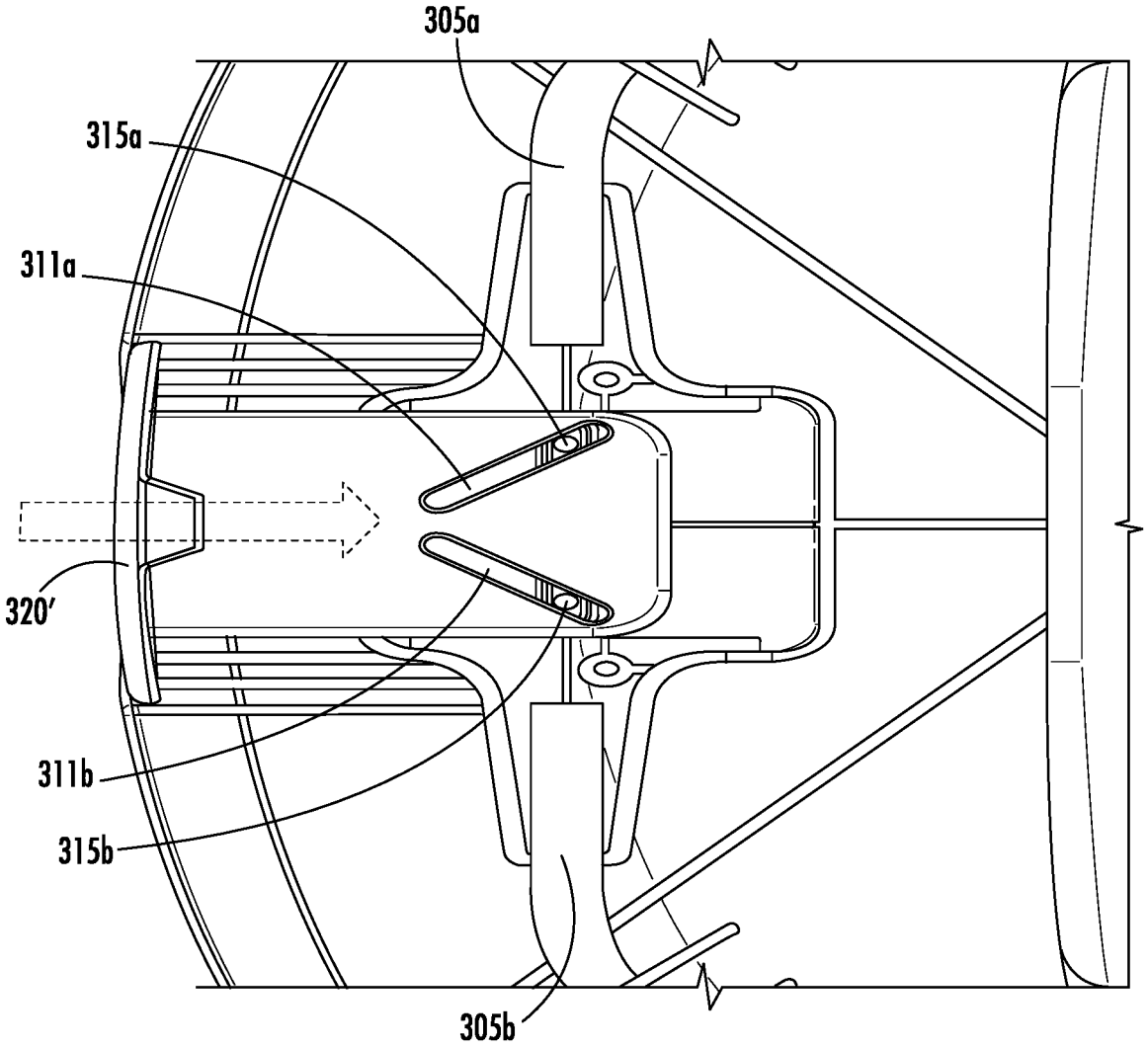
FIG. 8C is a bottom view of a tray actuator assembly according to one aspect.

The tray assembly 300 can also be configured to be removable from a remainder of the assembly 10. Additional aspects of the tray assembly 300 are illustrated in FIGS. 8A-9B. The tray assembly 300 can generally include a support surface 302 on an upper side. An underside of the tray assembly 300 can include an actuator 320 and a pair of arms 305*a*, 305*b* including latch assemblies 310*a*, 310*b*. In one aspect, the pair of arms 305*a*, 305*b* are formed as metal tubes. As shown in FIG. 8A, the metal tubes can have a bent profile such that at least a portion of the metal tubes engages directly against a bottom surface of the tray and provides structural support for the tray. Other configurations or profiles for the metal tubes can be used, as one of ordinary skill in the art would appreciate from this disclosure.

In one aspect, the actuator 320 is arranged in a middle region on the underside of the tray assembly 300. The actuator 320 could alternatively be provided on lateral sides of the tray assembly 300, or any other area of the tray assembly 300. Alternatively, the actuator 320 could be integrated with another part of the assembly 10 entirely, such as the first or second seat assemblies 100, 200 or the frame assembly 400.

The actuator 320 can be configured to be engaged by a user with a single hand. In one aspect, the actuator 320 includes a handle and is configured to be pulled outward in order to selectively actuate the latch assemblies 310*a*, 310*b*. In another aspect, shown in FIG. 8C, the actuator 320' includes a handle and defines at least one slot 311*a*, 311*b* configured to receive an end of a control element 315*a*, 315*b*, such as a control cable. The at least one slot can include a pair of slots 311*a*, 311*b* that have an angled profile. Based on this configuration, as the handle of the actuator 320' is pushed inward (i.e. the direction indicated by the arrow in FIG. 8C), the control elements 315*a*, 315*b* are pulled towards each other based on the angled orientation of the slots 311*a*, 311*b*. In other words, the linearly inward displacement of the actuator 320' is translated to tensioning or pulling of the control elements 315*a*, 315*b* due to the slots 311*a*, 311*b*. As the control elements 315*a*, 315*b* are pulled, the latch assemblies 310*a*, 310*b* are engaged or actuated. One of ordinary skill in the art would understand that either of the actuators 320, 320' can be used with the latch assemblies 310*a*, 310*b*, which are described in more detail herein.

Figure 9A:
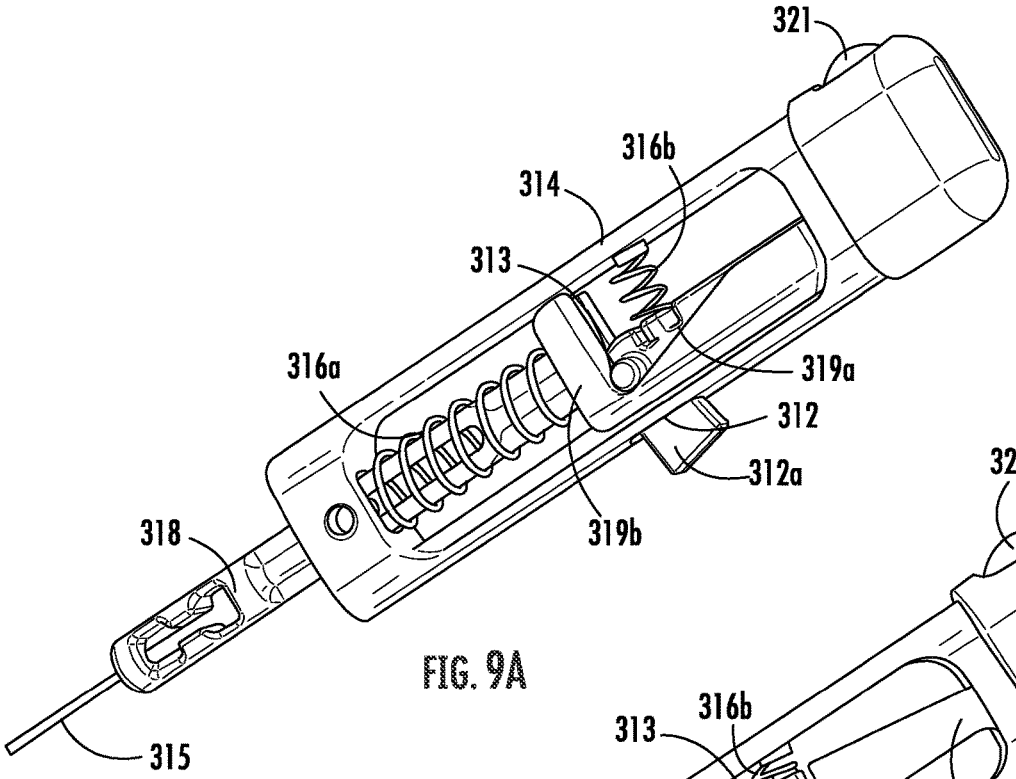
FIG. 9A is a side view of a latch assembly for the tray assembly.
Figure 9B:
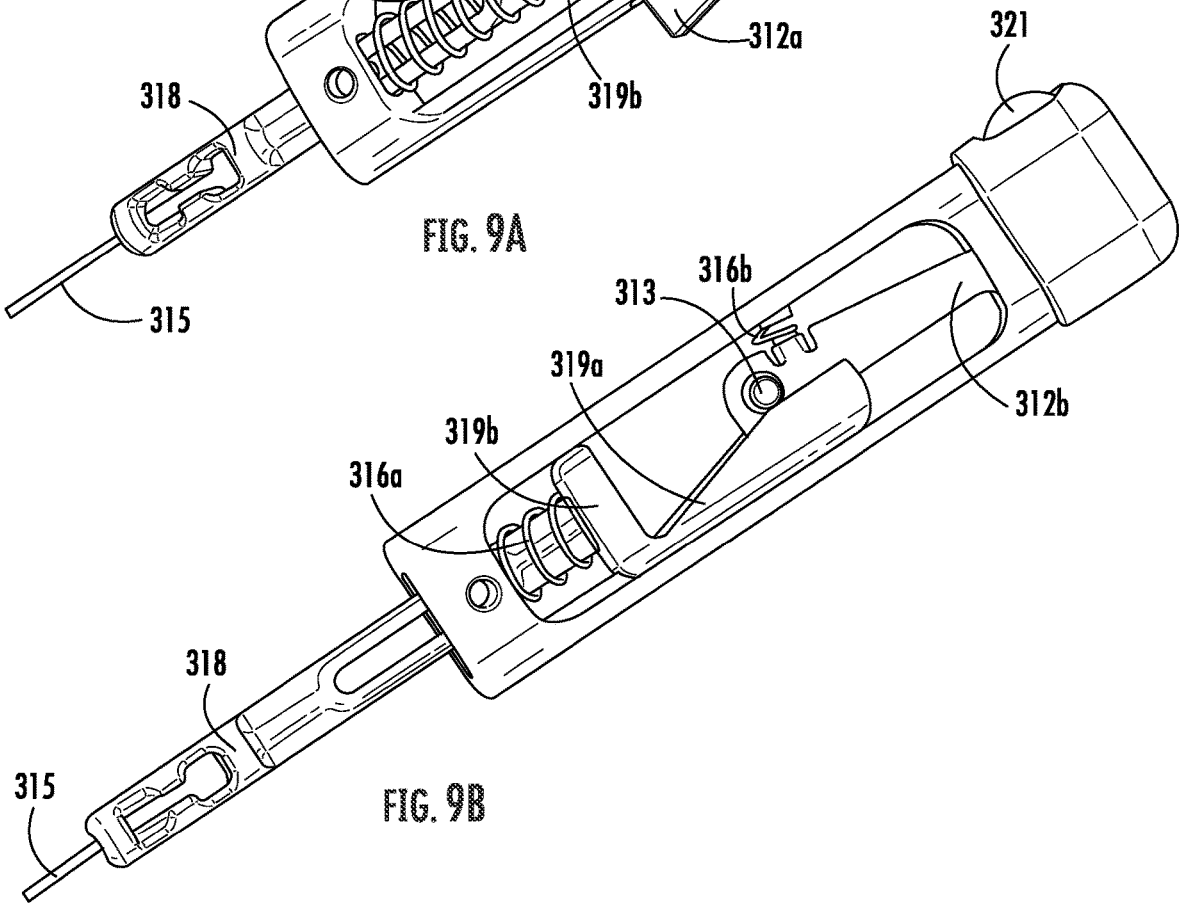
FIG. 9B is another side view of the latch assembly for the tray assembly.

As shown in FIGS. 9A and 9B, the latch assemblies 310*a*, 310*b* can include locking elements or latches 312 that are configured to be selectively engaged or locked with receptacles 112 (shown in FIG. 9C) defined by the first seat assembly 100. Specifically, a first end 312*a* of the latch 312 can be configured to be received within a portion of the first seat assembly 100. The latch assemblies 310*a*, 310*b* can include a housing 314 that is generally configured to selectively receive the latch 312 as the latch 312 is retracted based on a user engaging the actuator 320. The latch 312 can include another end 312*b* that is pivotally attached to the latch housing 314.

In one aspect, a pair of control elements 315, such as cables, extend from the actuator 320 and through the pair of arms 305*a*, 305*b*. The control elements 315 are configured to attach to a respective pair of plungers 318. The pair of plungers 318 are generally configured to be linearly displaced based on a user tensioning or pulling the control elements 315 via the actuator 320. Although the control elements 315 are illustrated as cables, one of ordinary skill in the art would understand that other linkages, connections, or structures can be used to generally provide some correlation between movement of the actuator 320 and at least a portion of the latch assemblies 310*a*, 310*b*.

In an initial state shown in FIG. 9A, the plunger 318 is in a first position that corresponds to the latch 312 being in an extended state. The plunger 318 can include an engagement surface 319*a* configured to engage a portion of the latch 312. In one aspect, the plunger 318 includes a plunger head 319*b* that defines the engagement surface 319*a*. In particular, the engagement surface 319*a* can include a ramped surface and the latch 312 can include a pin or post 313 that is configured to ride along the engagement surface 319*a* as the plunger head 319*b* is displaced.

As shown in FIGS. 9A and 9B, a biasing element 316*a* is generally arranged between a portion of the latch housing 314 and a portion of the plunger 318. The biasing element 316*a* is generally configured to bias the plunger head 319*b* towards a medial area of the latch housing 314. In one aspect, the biasing element 316*a* can be configured to drive the latch 312 to an extended position (i.e. locked state relative to the first seat assembly 100). Another biasing element 316*b*, such as a spring, can be arranged between a surface of the housing 314 and the latch 312. In one aspect, the biasing element 316*b* is configured to bias or force the latch 312 to an extended position. The biasing elements 316*a*, 316*b* can generally be configured to be perpendicular to each other, in one aspect.

FIG. 9B corresponds to an engaged or actuated state in which the actuator 320 is being engaged. In this state, the plunger 318 is pulled outward relative to the latch housing 314, causing the plunger head 319*b* to pull against the biasing element 316*a*. This movement causes the pin 313 to ride upward along the engagement surface 319*a* and thereby retracts the latch 312.

As shown in FIGS. 9A and 9B, at least one roller 321 can be provided that is configured to guide against an internal surface defined by the receptacles 112 in the first seat assembly 100. Other types of bearing surfaces or rolling surfaces and configurations can be used.

While one configuration of the actuator 320 and latch assemblies 310*a*, 310*b* are illustrated in FIGS. 8A-9B, one of ordinary skill in the art would understand that various other types of configurations can be provided. For example, the control elements 315 may be modified or omitted and/or various other types of engagement interfaces can be provided within the latch housing 314. In one aspect, the tray assembly 300 may be attached to the assembly 10 using a hook and retention element, in which a user must tilt the tray assembly 300 upwards or at some angle in order to release the hook from the retention element.

In one aspect, the adjustable chair assembly provides at least two different seats that are dimensioned to accommodate children of different sizes, and the adjustable chair assembly is configured to provide an adjustable height feature such that the adjustable chair assembly can be arranged at varying heights. Footrests for the two different seats are removably attached to the adjustable chair assembly such that a user can quickly and easily detach the footrests. The footrests can be used independently of one another. In one aspect, one of the footrests nests inside of the other footrest when not in use.

Figure 10:
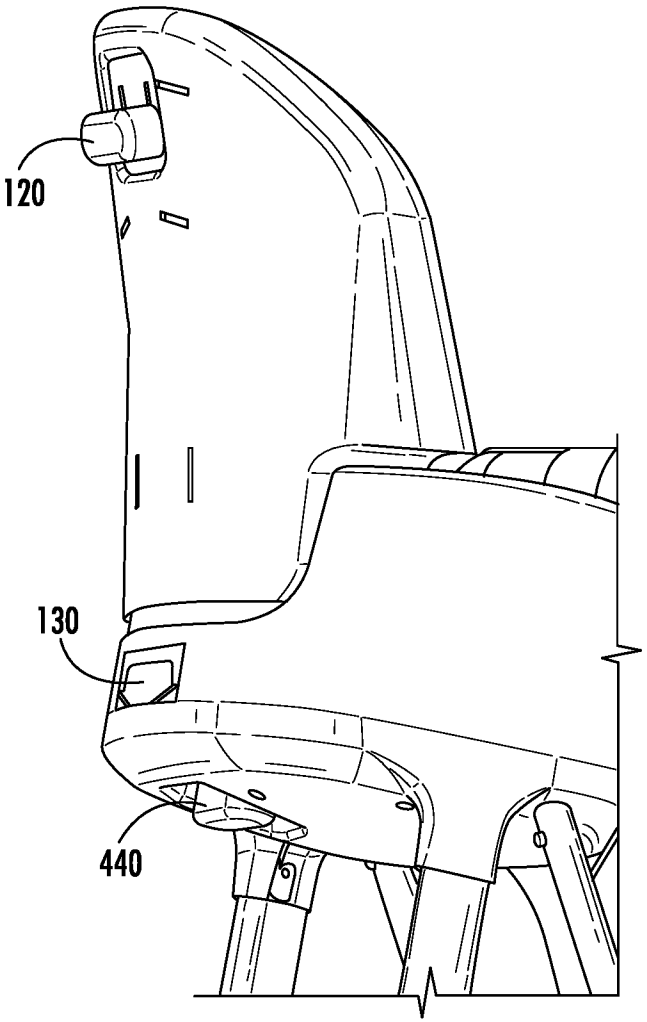
FIG. 10 is a rear perspective view of the adjustable chair assembly.
Figure 9C:
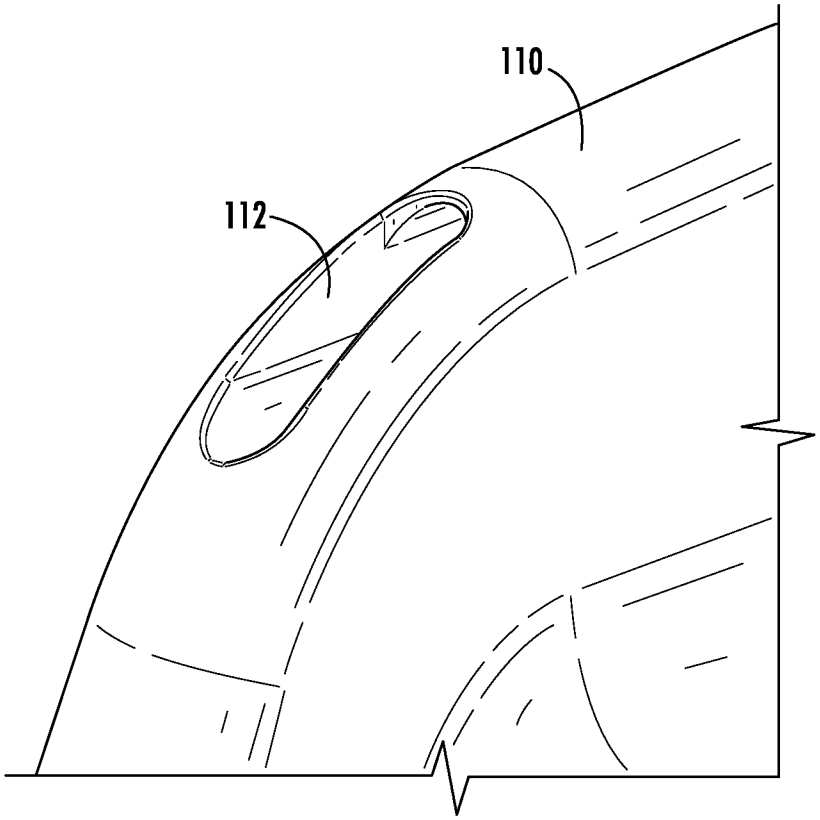
FIG. 9C is a perspective view of a receptacle associated with the latch assembly.

The adjustable chair assembly 10 includes a plurality of actuators. In one aspect, the actuator 440 can be considered a height adjustment actuator that is configured to generally adjust a height of the frame 400. The actuator 120 can be considered a seat adjustment actuator that is generally configured to adjust one portion of the first seat assembly 100 relative to another portion of the first seat assembly 100. The actuator 130 can be considered a seat release actuator that is generally configured to release or detach the first and second seat assemblies 100, 200 relative to each other. The actuator 320 can be considered a tray release actuator that is configured to release the tray assembly 300 relative to the adjustable chair assembly 10, and particularly from the first seat assembly 100. FIG. 10 illustrates the seat adjustment actuator 120, the seat release actuator 130, and the height adjustment actuator 440 as being on a single side, i.e. a rear side, of the adjustable chair assembly 10. One of ordinary skill in the art would understand that the position of these actuators can vary.

A method of adjusting at least one aspect of an adjustable chair assembly is also disclosed herein. In one aspect, the method includes engaging an actuator to selectively detach a first seat assembly from a second seat assembly. This step can include engaging the actuator with a single hand, and the actuator can be formed as a single handle or lever, in one aspect. The method can include adjusting various other aspects of the assembly, such as adjusting a height of the assembly or adjusting an angle of a seat back of one of the first or second seat assemblies. The method can include adjusting various aspects of the adjustable chair assembly using control elements that include cables.

Although the adjustable chair assembly 10 is illustrated as a highchair in the drawings, one of ordinary skill in the art would understand that any one or more of the features or aspects disclosed herein can be implemented with chairs of various configurations and arrangements that are not highchairs.

Having thus described the present embodiments in detail, it is to be appreciated and will be apparent to those skilled in the art that many physical changes, only a few of which are exemplified in the detailed description of the disclosure, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the disclosure being indicated by the appended claims rather than by the foregoing description, and all alternate embodiments and changes to this embodiment which come within the meaning and range of equivalency of said claims are therefore to be embraced therein.

The invention claimed is:

1. An adjustable chair assembly comprising:

a first seat assembly;

a first footrest;

a second seat assembly;

a second footrest configured to be used independently of the first footrest, wherein the second footrest is configured to nest inside of a cavity defined by the first footrest when the first footrest is in use and the second footrest is not in use, wherein the first and second seat assemblies are configured to be transitioned between a first state in which the first and second seat assemblies are attached to each other, and a second state in which the first and second seat assemblies are detached from each other; and a seat release actuator configured to detach the first and second seat assemblies from each other to transition from the first state to the second state.

2. The adjustable chair assembly according to claim 1, wherein the seat release actuator comprises a single handle.

3. The adjustable chair assembly according to claim 2, further comprising a retention element, wherein the seat release actuator is arranged on a first side of the first seat assembly and the retention element is arranged on a second side of the first seat assembly that is opposite from the first side.

4. The adjustable chair assembly according to claim 1, further comprising a frame assembly configured to support the first and second seat assemblies, and a height adjustment actuator configured to adjust a height of the frame assembly.

5. The adjustable chair assembly according to claim 1, wherein the first seat assembly further comprises a seat adjustment actuator configured to adjust at least one first portion of the first seat assembly relative to at least one second portion of the first seat assembly.

6. The adjustable chair assembly according to claim 5, wherein the seat adjustment actuator is configured to adjust an angle of a seat back of the first seat assembly relative to a seat portion of the first seat assembly.

7. The adjustable chair assembly according to claim 1, wherein the cavity is defined on a rearward face of the first footrest.

8. The adjustable chair assembly according to claim 1, wherein the first footrest is detachable from the first seat assembly.

9. The adjustable chair assembly according to claim 8, wherein removal of the first footrest from the first seat assembly causes the second footrest to also be removed from the first seat assembly.

10. The adjustable chair assembly according to claim 1, wherein the second footrest is configured to be removably attached to the second seat assembly.

11. The adjustable chair assembly according to claim 1, wherein the second footrest includes at least one coupler configured to attach the second footrest to the second seat assembly.

12. The adjustable chair assembly according to claim 11, wherein the at least one coupler includes at least one first coupler configured to be engaged within the second seat assembly to secure the second footrest, and at least one second coupler configured to be exposed when the second footrest is secured to the second seat assembly.

13. The adjustable chair assembly according to claim 12, wherein the at least one first coupler is linked with the at least one second coupler, such that displacement of the at least one second coupler causes the at least one first coupler to also be displaced.

* * * * *